US010777940B2

(12) United States Patent
Zhao

(10) Patent No.: US 10,777,940 B2
(45) Date of Patent: Sep. 15, 2020

(54) ELECTRICAL CONNECTOR HAVING A PAIR OF BRACKETS WITH COPLANARITY FEATURE

(71) Applicants: FUYU ELECTRONICAL TECHNOLOGY (HUAIAN) CO., LTD., Huai'an (CN); FOXCONN INTERCONNECT TECHNOLOGY LIMITED, Grand Cayman (KY)

(72) Inventor: Jun Zhao, Huaian (CN)

(73) Assignees: FUYU ELECTRONICAL TECHNOLOGY (HUAIAN) CO., Huai'an (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/423,192

(22) Filed: May 28, 2019

(65) Prior Publication Data

US 2019/0372275 A1 Dec. 5, 2019

(30) Foreign Application Priority Data

May 29, 2018 (CN) ..... 2018 2 0819538 U

(51) Int. Cl.
*H01R 13/6581* (2011.01)
*H01R 24/60* (2011.01)
*H01R 13/66* (2006.01)

(52) U.S. Cl.
CPC ..... *H01R 13/6581* (2013.01); *H01R 13/665* (2013.01); *H01R 24/60* (2013.01)

(58) Field of Classification Search
CPC ..... H01R 12/7011; H01R 12/7047; H01R 13/6581; H01R 13/6594; H01R 13/665; H01R 24/60
See application file for complete search history.

(56) References Cited

U.S. PATENT DOCUMENTS

| | | | | |
|---|---|---|---|---|
| 5,249,983 | A * | 10/1993 | Hirai | H01R 12/7023 439/573 |
| 6,354,870 | B1 * | 3/2002 | Timmerman | H01R 13/6595 439/569 |
| 8,292,662 | B2 * | 10/2012 | Yang | H01R 13/5202 439/271 |
| 8,597,051 | B2 | 12/2013 | Yang | |
| 8,827,742 | B2 | 9/2014 | Wang | |
| 9,761,988 | B1 * | 9/2017 | Lin | H01R 13/5216 |
| 9,954,317 | B2 | 4/2018 | Zhao | |
| 10,148,041 | B2 | 12/2018 | Lyon | |

(Continued)

FOREIGN PATENT DOCUMENTS

CN 106410465 2/2017

*Primary Examiner* — Oscar C Jimenez
(74) *Attorney, Agent, or Firm* — Wei Te Chung; Ming Chieh Chang

(57) ABSTRACT

An electrical connector includes: a contact module including an insulative housing and an upper and lower rows of contacts; a shielding shell enclosing the contact module; an insulative outer cover enclosing the shielding shell; and a pair of brackets secured to the insulative outer cover, each bracket including a mounting portion having a bottom surface and a hole, wherein the mounting portion further has three downward protrusions leveled lower than the bottom surface.

16 Claims, 8 Drawing Sheets

(56) References Cited

U.S. PATENT DOCUMENTS

| | | | | |
|---|---|---|---|---|
| 2013/0344734 | A1* | 12/2013 | Yokoyama | H01R 13/60 439/569 |
| 2015/0087189 | A1* | 3/2015 | Zhang | H01R 13/41 439/676 |
| 2015/0155661 | A1* | 6/2015 | Chen | H01R 13/6582 439/607.01 |
| 2016/0072208 | A1* | 3/2016 | Li | H01R 13/6594 439/78 |
| 2016/0164220 | A1* | 6/2016 | Kataoka | H01R 13/5202 439/559 |
| 2016/0233594 | A1* | 8/2016 | Zhao | H01R 13/6581 |
| 2017/0155216 | A1* | 6/2017 | Yao | H01R 12/722 |
| 2017/0162976 | A1* | 6/2017 | Zhao | H01R 24/60 |
| 2017/0207570 | A1* | 7/2017 | Guo | H01R 12/722 |
| 2017/0222342 | A1* | 8/2017 | Ho | H01R 24/62 |
| 2017/0338602 | A1* | 11/2017 | Ho | H01R 13/6595 |
| 2018/0145461 | A1* | 5/2018 | Zhao | H01R 13/405 |

* cited by examiner

ELECTRICAL CONNECTOR HAVING A PAIR OF BRACKETS WITH COPLANARITY FEATURE

BACKGROUND OF THE INVENTION

1. Field of the Invention

The present invention relates to an electrical connector having a mounting bracket for reliably sitting on a printed circuit board.

2. Description of Related Art

China Patent No. 106410465 discloses an electrical connector comprising a contact module, a shielding shell enclosing the contact module, an insulative outer cover enclosing the shielding shell, and a pair of brackets insert-molded with the insulative outer cover and fastened to the shielding shell, wherein each bracket includes a mounting leg for entering a plated through hole of a printed circuit board to which the electrical connector is mounted.

SUMMARY OF THE INVENTION

An electrical connector comprises: a contact module including an insulative housing and an upper and lower rows of contacts, the insulative housing having a base and a tongue, the upper and lower rows of contacts being exposed respectively to an upper and lower surfaces of the tongue; a shielding shell enclosing the contact module; an insulative outer cover enclosing the shielding shell; and a pair of brackets secured to the insulative outer cover, each bracket including a mounting portion having a bottom surface and a hole, wherein the mounting portion further has three downward protrusions leveled lower than the bottom surface.

DETAILED DESCRIPTION OF THE PREFERRED EMBODIMENT

Figure 1:
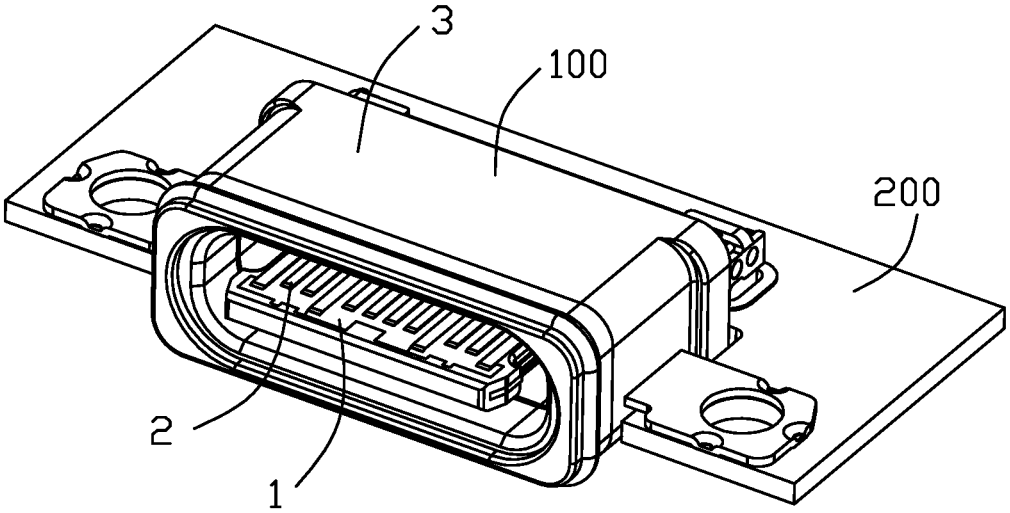
FIG. 1 is a perspective view of an electrical connector in accordance with the present invention sitting on a printed circuit board.
Figure 2:
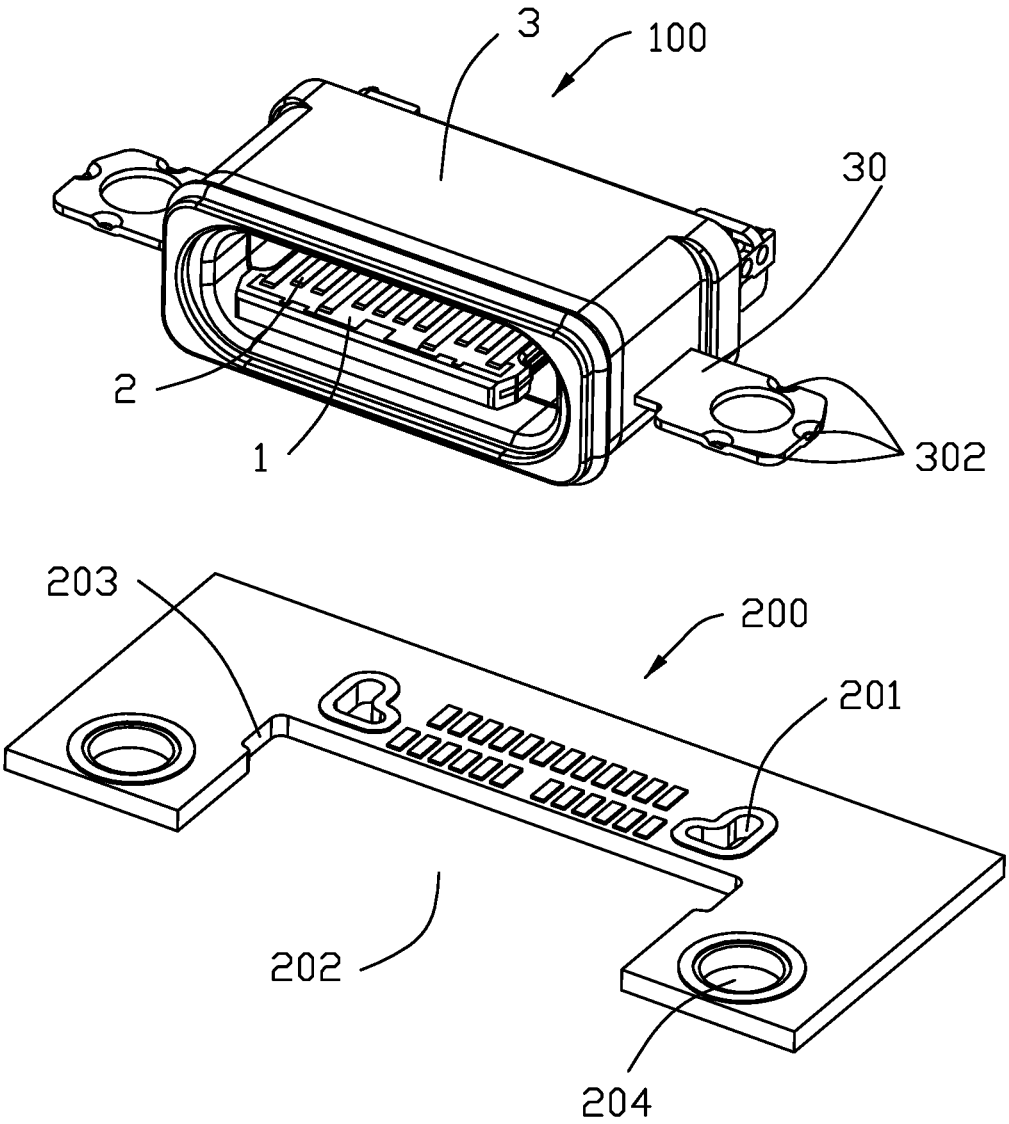
FIG. 2 is an exploded view of FIG. 1.
Figure 3:
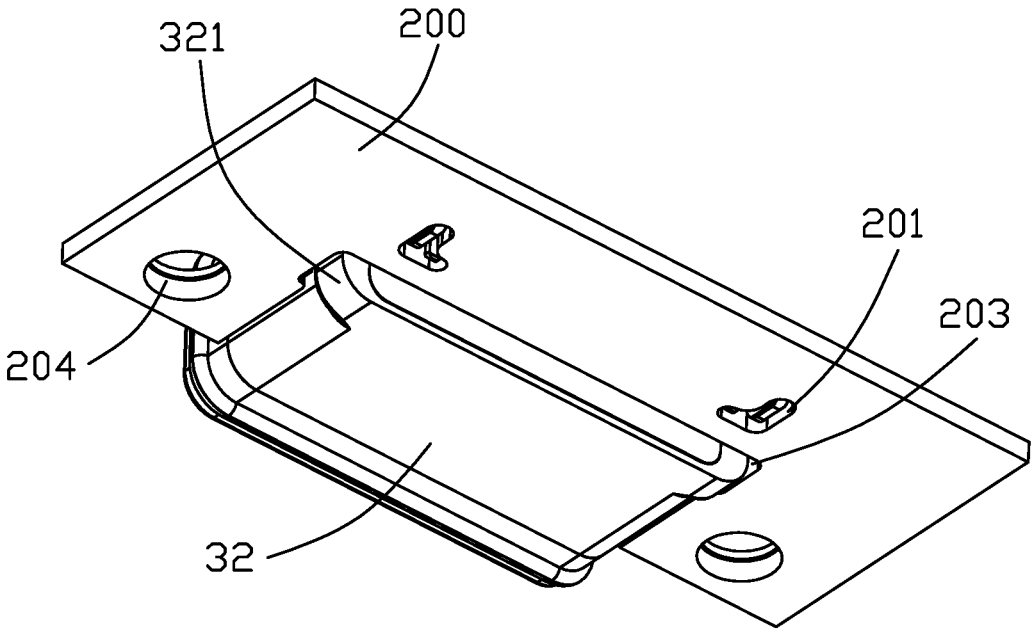
FIG. 3 is a bottom perspective view of FIG. 1.
Figure 4:
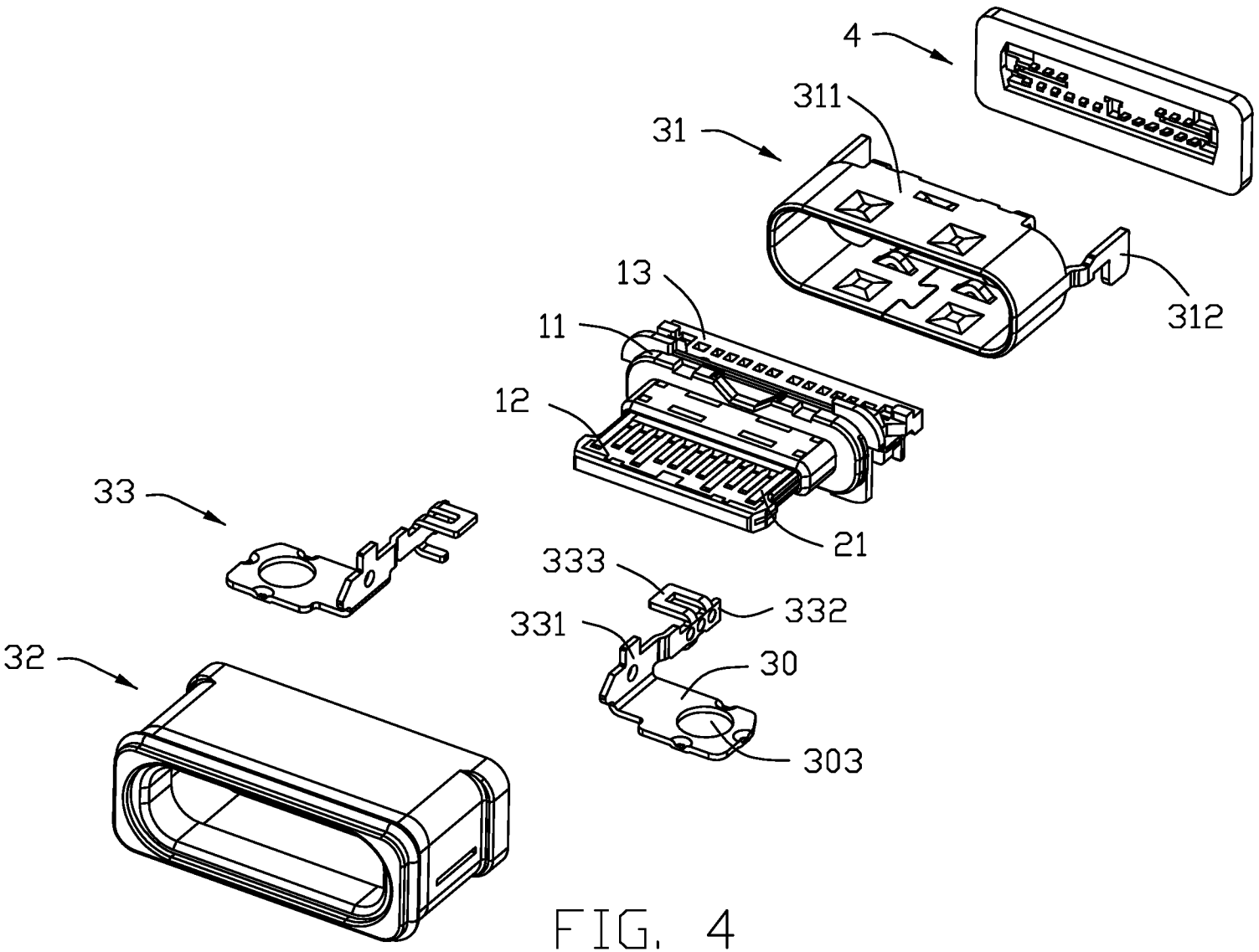
FIG. 4 is an exploded view of the electrical connector.
Figure 5:
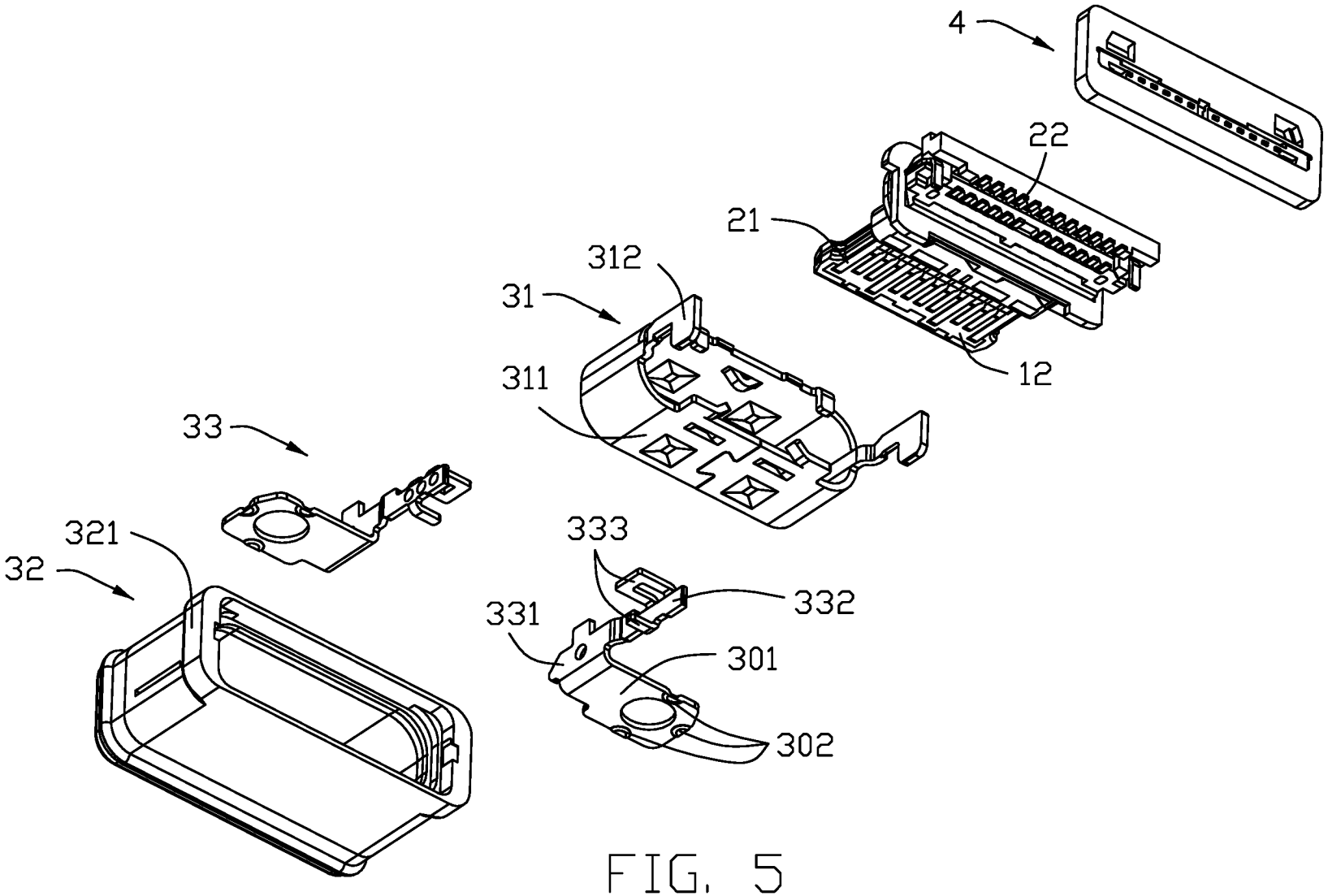
FIG. 5 is a view similar to FIG. 4 but from a different perspective.
Figure 6:
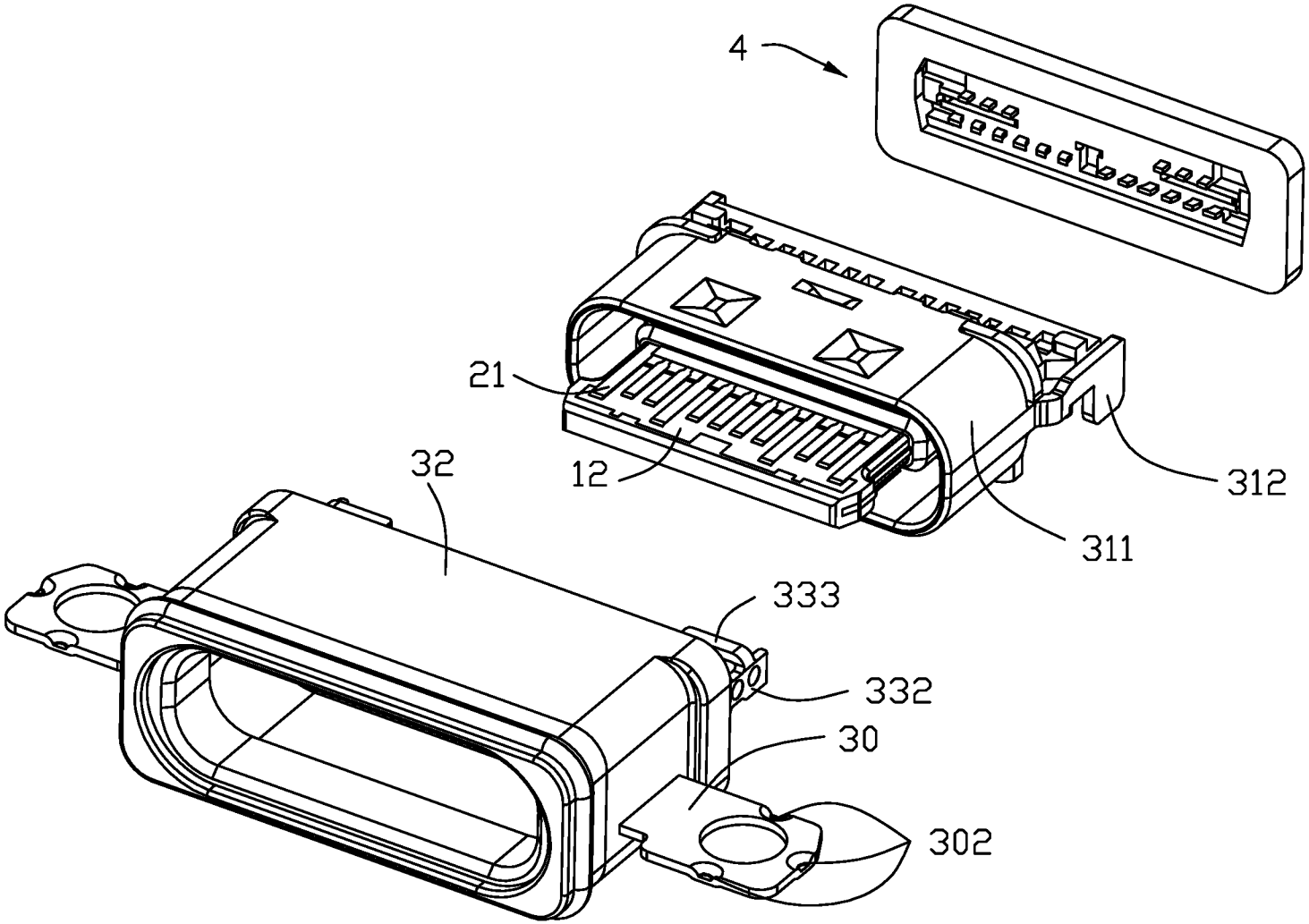
FIG. 6 is a partly assembled view of FIG. 4.
Figure 7:
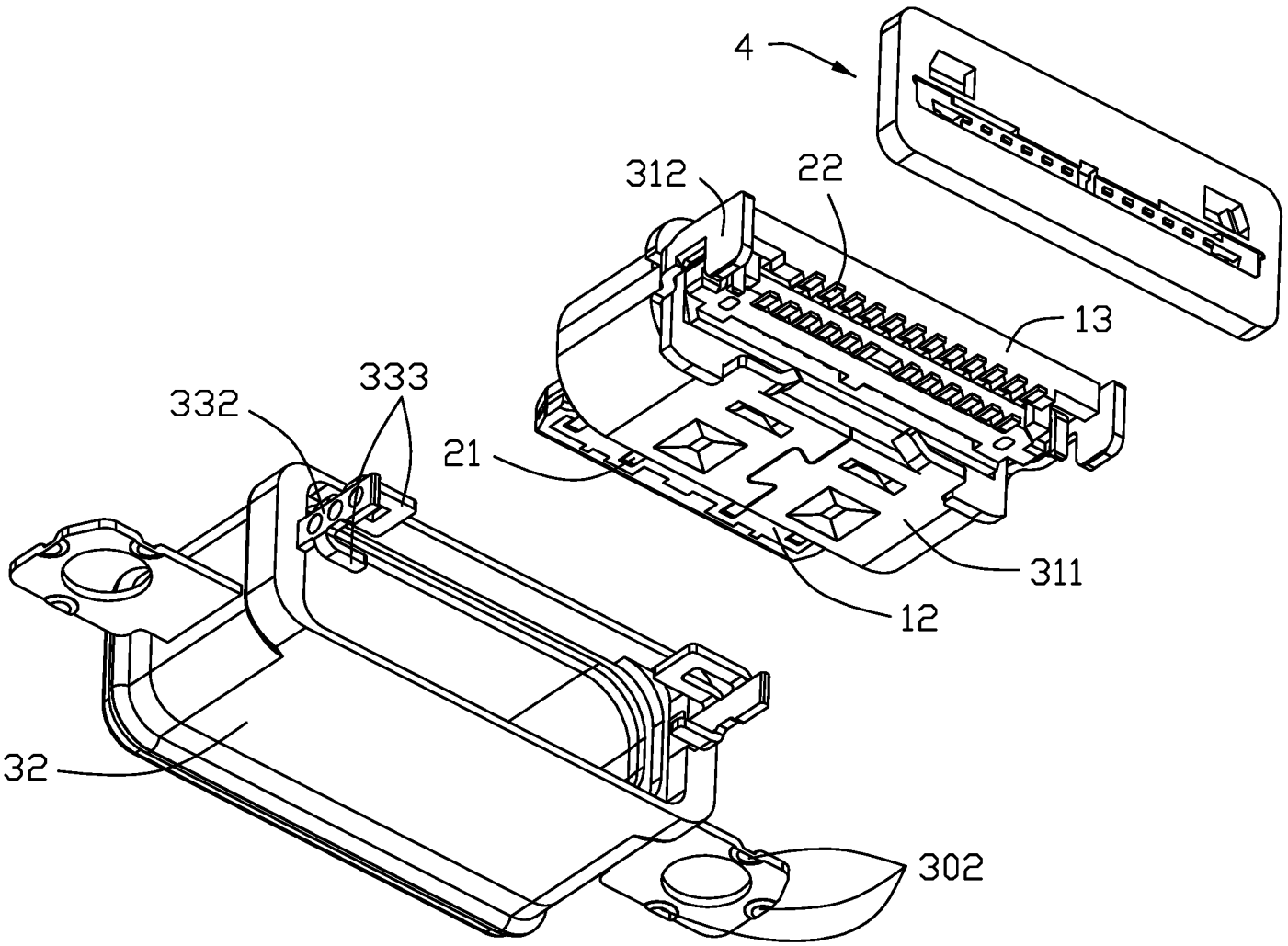
FIG. 7 is a view similar to FIG. 6 but from a different perspective.

Referring to FIGS. 1-8, an electrical connector 100 to be mounted on a printed circuit board (PCB) 200 comprises a contact module and a shielding unit 3 enclosing the contact module. The contact module includes an insulative housing 1 and an upper and lower rows of contacts 2. The electrical connector 100 may further include a rear sealing member 4 for sealing an interface between the contact module and the shielding unit 3. The shielding unit 3 includes a pair of L-shaped brackets 33 each having a side mounting portion 30.

The insulative housing 1 has a base 11, a front tongue 12, and a rear extension 13. Each of the upper and lower contacts 2 has a contacting portion 21, a soldering portion 22, and an intermediate securing portion. The contacting portions 21 are exposed respectively to an upper and lower surfaces of the tongue 12. To ensure that the connector 100 is reliably soldered to the PCB 200, the two mounting portions 30 are required to be coplanar. Each mounting portion 30 has a bottom surface 301. The mounting portion 30 also has a hole 303 for inserting a fastener to the PCB 200. The mounting portion 30 further has three downward protrusions 302 leveled lower than the bottom surface 301 in the vertical direction. The three downward protrusions 302 are located at a peripheral edge of the mounting portion 30 around the hole 303. With provision of such downward protrusions 302 on the mounting portion 30, coplanarity during fastening may be easily obtained in the mounting portions 30, which is beneficial to reliable soldering of the contact soldering portions 22 to the PCB 200. Preferably, the three downward protrusions 302 are disposed respectively at a front, a rear, and a side of the mounting portion 30.

The shielding unit 3 has a shielding shell 31 enclosing the insulative housing 1 and an insulative outer cover 32 enclosing the shielding shell 31. The shielding shell 31 includes a main part 311 and a pair of soldering legs 312 at rear sides of the main part. The brackets 33 are insert-molded or otherwise secured on two sides of the insulative outer cover 32. Each bracket 33 includes a securing portion 331 embedded within the outer cover 32, the mounting portion 30 that extends outward from the securing portion, and a fastening portion 332 extending rearward from the securing portion 331. The fastening portion 332 has claws 333 and is spot welded to the soldering leg 312 for strengthening. The claw 333 further forms an engagement opening to receive the corresponding upward protrusion (not labeled) of the rear extension 13 for retaining the contact module in position in the outer cover 32. Notably, the contact module is forwardly inserted into the interior space of the outer cover 32 so the securing between the claw 333 and the rear extension 13 or between the fastening portion 332 and the soldering leg 312 is helpful to prevent the backward movement of the contact module with regard to the outer cover 32.

Figure 8:
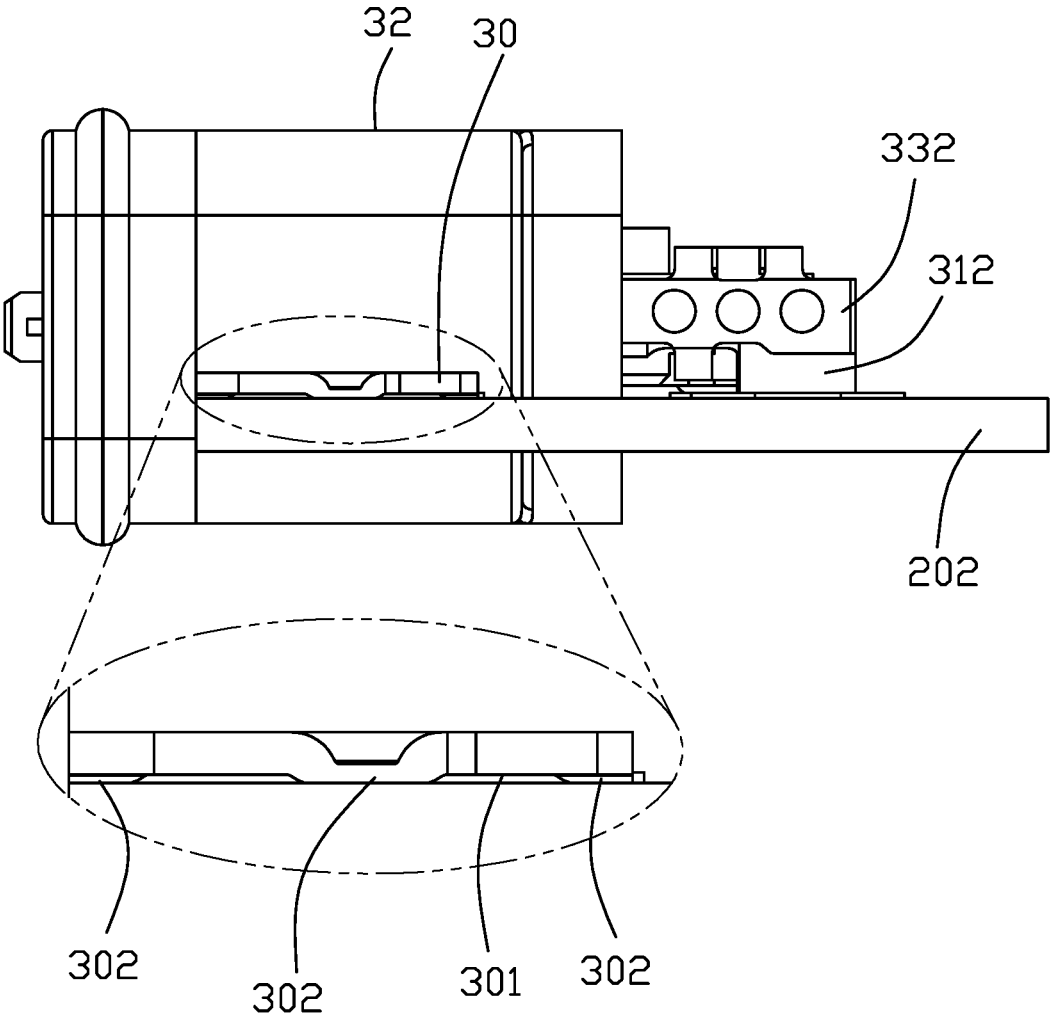
FIG. 8 is a side view of FIG. 1 with a portion thereof enlarged.

The soldering legs 312 extend into and secured in holes 201 provided on the PCB 200 to assist in stabilizing the connector 100 in position ready for soldering. The PCB 200 also has a notch 202 with features 203 to accommodate the insulative outer cover 32 with features 321. The PCB 200 further has a pair of holes 204 spaced from each other in a transverse direction perpendicular to the vertical direction for fasteners (not shown) inserting through the holes 303 to enter and be secured therein. As shown in FIG. 8, in this embodiment the protrusion 302 forms a flat bottom face for complying with the upper plane of the printed circuit board 200. It is also noted that the downward protrusions 302 are formed at the edge rather than in the middle region. It is because it is relatively easy to control the formation of the downward protrusion at the edge, especially for forming the flat bottom face, compared with those formed in the middle region.

What is claimed is:

1. An electrical connector comprising:

a contact module including an insulative housing and an upper and lower rows of contacts, the insulative housing having a base and a tongue, the upper and lower rows of contacts being exposed respectively to an upper and lower surfaces of the tongue;

a shielding shell enclosing the contact module;

an insulative outer cover enclosing the shielding shell; and a pair of metallic brackets secured to the insulative outer cover, each bracket including a mounting portion having a bottom surface and a hole, wherein the mounting portion further has only three downward protrusions leveled lower than the bottom surfaces, and the three downward protrusions are disposed respectively at a front, a rear, and a side of the mounting portion around the hole.

2. The electrical connector as claimed in claim 1, wherein the three downward protrusions are located at a peripheral edge of the mounting portion.

3. The electrical connector as claimed in claim 1, wherein the pair of brackets are insert-molded with the insulative outer cover.

4. The electrical connector as claimed in claim 1, wherein the pair of brackets are fastened to the shielding shell.

5. An electrical connector assembly comprising:

a printed circuit board forming a notch and a pair of through holes by two sides of the notch in a transverse direction;

a contact module including an insulative housing and a plurality of contacts retained in the housing, the insulative housing having a base and a tongue, the plurality of contacts being exposed upon at least one of opposite upper and lower surfaces of the tongue;

a shielding shell enclosing the contact module;

an insulative outer cover enclosing the shielding shell; and a pair of metallic brackets secured to the insulative outer cover, each bracket including a mounting portion having a bottom surface and a hole, wherein the bottom surface intimately downwardly confronts an upper surface of the printed circuit board, and the hole is aligned with a corresponding through hole in a vertical direction perpendicular to the transverse direction; wherein the mounting portion further has at least three downward protrusions leveled lower than the bottom surface in the vertical direction so as to form a tiny gap between the bottom surface of the mounting portion and the upper surface of the printed circuit board in the vertical direction; and the three downward protrusions are located at a front side, a rear side, and a lateral side of the mounting portion; wherein the downward protrusions are located at a peripheral edge of the mounting portion, and each protrusion is directly spanned, in a top view, from the peripheral edge toward the hole in the corresponding mounting portion.

6. The electrical connector assembly as claimed in claim 5, wherein each of said protrusions has a flat bottom face to be intimately seated upon the upper surface of the printed circuit board compliantly.

7. The electrical connector assembly as claimed in claim 5, wherein the pair of brackets are insert-molded with the insulative outer cover.

8. The electrical connector assembly as claimed in claim 5, wherein the pair of brackets are fastened to the shielding shell.

9. The electrical connector assembly as claimed in claim 8 wherein the pair of brackets are fastened to the contact module.

10. An electrical connector assembly comprising:

a printed circuit board forming a notch and a pair of through holes by two sides of the notch in a transverse direction;

a contact module including an insulative housing and a plurality of contacts retained in the housing, the insulative housing having a base and a tongue, the plurality of contacts being exposed upon at least one of opposite upper and lower surfaces of the tongue;

a shielding shell enclosing the contact module;

an insulative outer cover enclosing the shielding shell; and a pair of metallic L-shaped brackets spaced from each other and discrete from the insulative outer cover while being secured to the insulative outer cover via insert-molding, each bracket including a horizontal mounting portion having a bottom surface and a hole, and a vertical securing portion linked with the horizontal mounting portion and embedded within the insulative outer cover, wherein the bottom surface intimately downwardly confronts an upper surface of the printed circuit board, and the hole is aligned with a corresponding through hole in a vertical direction perpendicular to the transverse direction; wherein the mounting portion further has a plurality of downward protrusions leveled lower than the bottom surface in the vertical direction so as to form a tiny gap between the bottom surface of the mounting portion and the upper surface of the printed circuit board in the vertical direction.

11. The electrical connector assembly as claimed in claim 10, wherein each of said protrusion has a flat bottom face to be intimately seated upon the upper surface of the printed circuit board compliantly.

12. The electrical connector assembly as claimed in claim 10, wherein the downward protrusions are located at a peripheral edge of the mounting portion, and each protrusion is directly spanned from the peripheral edge toward the hole in the corresponding mounting portion in a top view taken along the vertical direction.

13. The electrical connector assembly as claimed in claim 12, wherein the downward protrusions are located at at least on a front side and a rear side of the mounting portion.

14. The electrical connector assembly as claimed in claim 12, wherein the downward protrusions are located at all a front side, a rear side and a lateral side of the mounting portion.

15. The electrical connector assembly as claimed in claim 10, wherein the pair of brackets are further fastened to the shielding shell.

16. The electrical connector assembly as claimed in claim 10, wherein the pair of brackets are further fastened to the contact module.

* * * * *